United States Patent [19]

Howe, Jr.

[11] 4,407,473

[45] Oct. 4, 1983

[54] BAG DISPENSER

[75] Inventor: Milton A. Howe, Jr., Spartanburg, S.C.

[73] Assignee: W. R. Grace & Co., Duncan, S.C.

[21] Appl. No.: 254,016

[22] Filed: Apr. 13, 1981

Related U.S. Application Data

[62] Division of Ser. No. 54,219, Jul. 2, 1979, Pat. No. 4,280,811.

[51] Int. Cl.[3] ..... B65B 67/12

[52] U.S. Cl. ..... 248/95; 211/49 D

[58] Field of Search ..... 248/95; 211/49 D; 53/570; 221/45, 55, 58, 63; 206/554

[56] References Cited

U.S. PATENT DOCUMENTS

| | | | |
|---|---|---|---|
| 404,260 | 5/1889 | Conant . | |
| 1,070,169 | 8/1913 | Ott . | |
| 1,565,369 | 12/1925 | Ishikawa . | |
| 2,069,266 | 2/1937 | Nicodemus . | |
| 2,142,808 | 1/1939 | Thor | 221/55 |
| 2,245,518 | 6/1941 | Allen . | |
| 2,673,134 | 3/1954 | Barnett . | |
| 2,955,706 | 10/1960 | Emrick | 248/174 |
| 3,044,233 | 7/1962 | Altman . | |
| 3,672,494 | 6/1972 | Eichin | 206/449 |
| 3,679,096 | 7/1972 | Musser . | |
| 3,738,482 | 6/1973 | Cwikla . | |
| 3,782,073 | 1/1974 | Musser . | |
| 3,835,993 | 9/1974 | Howe et al. . | |
| 3,851,762 | 12/1974 | Liblick . | |
| 3,896,966 | 7/1975 | Canno . | |
| 4,089,412 | 5/1978 | Baugh . | |

FOREIGN PATENT DOCUMENTS

| | | |
|---|---|---|
| 719570 | 10/1965 | Canada . |
| 222801 | 10/1924 | United Kingdom . |
| 225121 | 11/1924 | United Kingdom . |
| 486466 | 6/1938 | United Kingdom . |
| 1073913 | 6/1967 | United Kingdom . |
| 1209406 | 10/1970 | United Kingdom . |

*Primary Examiner*—J. Franklin Foss

*Attorney, Agent, or Firm*—John J. Toney; William D. Lee, Jr.; Joseph P. Harps

[57] ABSTRACT

Bags are dispensed from a stack of bags by locating the stack of bags on a dispensing surface and elastically pinching the stack of bags to the dispensing surface with an elastic compression means. The bags are thus capable of being removed from the stack one at a time without otherwise disrupting the stack.

4 Claims, 4 Drawing Figures

BAG DISPENSER

This is a division, of application Ser. No. 54,219, filed July 2, 1979, now U.S. Pat. No. 4,280,811.

BACKGROUND OF THE INVENTION

This invention relates to the art of bag dispensing and more particularly relates to an assemblage of bags which permits one at a time removal of the bags without otherwise disrupting the assemblage.

In the packaging of articles for shipment, display or otherwise preparing articles for sale, the efficiency and speed of the overall packaging process is often determined by the ease with which an operator can obtain a bag for use in the packaging process. Because of the importance of dispensing bags to an operator in a packaging process, various techniques have been devised within the art to facilitate and expedite the packaging process.

One such technique is disclosed in U.S. Pat. No. 3,672,494 wherein a stack of containers is folded within a shipping container and adapted to be partially unfolded and dispensed from the stack by an operator during a packaging process. This stack of bags is retained in tact by the co-action of a rod within the fold and a resilient member pressing against the stack of bags and the rod on the outer portion of the fold.

Another technique is described in U.S. Pat. No. 3,331,182 wherein an assemblage of containers are attached to a carrier and moved by the carrier to a dispensing position for removal by an operator and insertion of an object into the bag. This type of packaging arrangement has become known to the art as taped bags. Taped bags have generally been widely accepted within the art and have proven to be one of the most versatile dispensing arrangements.

While the taped bags described above have proved to be entirely satisfactory for packaging in most applications, the art requires the versatility of differing techniques to adapt itself to various packaging environments.

SUMMARY OF THE INVENTION

It is thus an object of this invention to provide a new technique for dispensing bags for use in a packaging process.

It is a further object of this invention to provide an assemblage of bags which may be readily one at a time.

It is a still further object of this invention to provide such an assemblage of bags which is readily shippable and convertible to the dispensing mode.

These as well as other objects are accomplished by an assemblage of bags comprising coinciding stacked bags elastically pinched across the edges of the stack to a dispensing surface.

DETAILED DESCRIPTION

In accordance with this invention, it has been found that a stack of bags may be dispensed from a stack one at a time when such a stack is elastically pinched at its edges to a dispensing surface.

The bags utilized in accordance with this invention may be formed from any conventional packaging material. Such materials include copolymers of vinylidene chloride (saran), polyethylene, polypropylene, olefin polymers and copolymers, polyesters, and craft paper. Preferrably, the bags utilized in this invention are advanced laminate materials such as those described in U.S. Pat. No. 3,741,253 to Harri J. Brax et al. The term bag is utilized broadly to include containers of any type. The term is thus utilized to include what may be referred to in the art as bags, casings, pouches or flat wrapping sheets.

The assemblage of bags in accordance with this invention are dispensed one at a time from the top of a stack of bags while retaining the stack in tact. The assemblage of bags and the process for so dispensing in accordance with this invention can be best understood by referring to the various figures of drawings and to the following detailed description.

Figure 1:
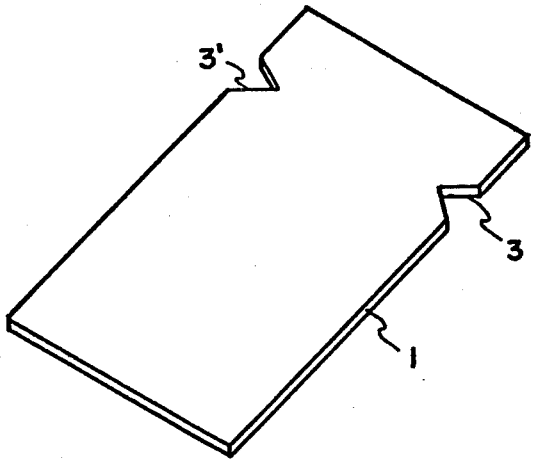
FIG. 1 is an isometric view of a dispensing surface in accordance with this invention.
Figure 2:
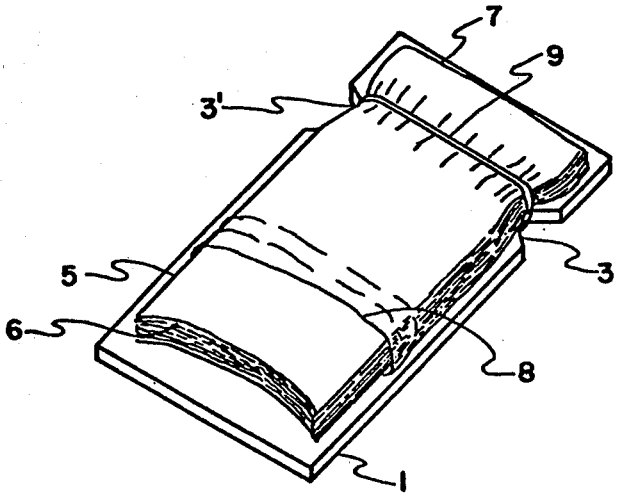
FIG. 2 is an isometric view of the dispensing surface of FIG. 1 with coinciding stacked bags elastically pinched along the edges thereof to the dispensing surface.

FIG. 1 of the drawings depicts a dispensing surface or backing board 1 for use in holding a stack of bags to be dispensed. The backing board 1 has indentations or means for otherwise permitting an elastic pinching means such as 9 shown in FIG. 2 to pinch the edge of a stack of bags. FIG. 2 of the drawings shows the backing board 1 having a stack of bags 5 resting thereon. The stack of bags has open ends 6 and closed ends 7 arranged for grasping by the opened end. The bags are preferrably dispensed by removing the top bag from the stack, but may be dispensed by removing intermediate bags from the stack.

It is essential to the process of dispensing, in accordance with this invention, that the elastic pinching means 9 and the top bag (the bag, preferrably, to be next dispensed) be either separated or have a low coefficient of friction between them such that the top bag may be readily dispensed without undue slippage resistance by the elastic pinching means. A simple and expeditious way to provide such slippage is by means of a sheath 8 in which the stack of bags is retained while pinched to the dispensing surface. The sheath is preferrably formed of the same material as bags and is preferrably another bag of a size sufficient to contain the stack of bags. The sheath 8, however, is merely one such means by which this result may be accomplished. Alternatively, the elastic pinching means may be formed from a low coefficient of friction material such as teflon in order to permit slippage between the top bag of the stack of bags and the pinching means.

The elastic pinching means is preferrably a common rubber band. However, it is not necessary that the elastic pinching means be such a rubber band. It may, for example, be a teflon tape which is elastically held by a spring or other elastic means beneath the dispensing surface whereby the otherwise non-elastic teflon elastically exerts pressure to pinch the stack of bags to the dispensing surface.

The essential aspect of this invention is that the elastic pinching means actually pinch, or crimp, the edge of the stack of bags resting upon the dispensing surface. In order to ideally design a dispensing surface for use of this invention, the indentations such as 3 and 3' of FIG. 1 should be indented so that the distance between indentations is less than the width of the bag size to be dispensed. As an alternative to indentations of the type shown on the backing board, the backing board may otherwise be adapted to permit an elastic means to be adjustably placed thereon. Such flexibility may be provided by a series of apertures through the backing board through which an elastic pinching means may be passed. Preferrably, the width difference between the indentations or apertures and the bags to be dispensed is approximately one inch (one-half inch from the bag edge on each side). However, this distance may vary considerably for various size bags. It has been found that a difference of from 1/10 to about 4 inches may be utilized for bags dispensed in accordance with this invention.

The location of the elastic pinching means along the length of the bag is not critical to the dispensing function so long as sufficient material is available for grasping at the dispensing end. Preferrably, however, the elastic pinching means is located on the lower one-third of the stack.

The essential aspect of the cooperation between the dispensing surface and the elastic pinching means is that the bag edges are pinched or crimped. For this reason the degree of tension in the elastic pinching means is not critical. The degree of tension need only be sufficient to crimp the edges but not sufficient to make bag removal difficult.

While the backing board 1 which defines the dispensing surface is shown as being substantially planar, it may be curved either convexly or concavely and still dispense with equal efficacy. Other surface configurations are also useful. It has also been found that when dispensing from a large stack of bags that if the lowermost portion of the stack is sufficiently rigid, it may serve the purpose of a dispensing surface. This type of dispensing surface would of course only be useful for so long as the stack of bags was sufficiently thick to be substantially rigid.

Figure 3:
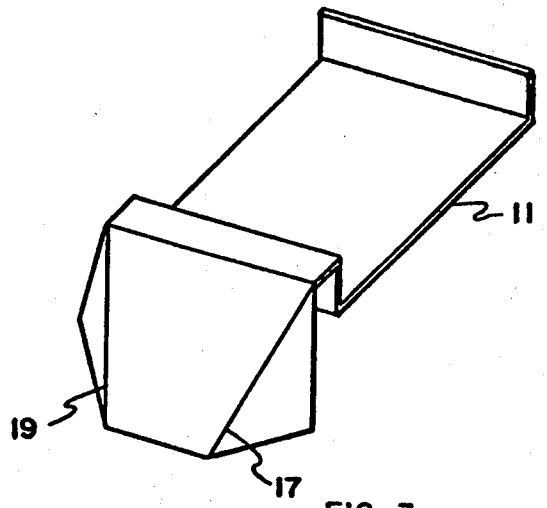
FIG. 3 is an isometric view of a holder on which the assemblage of bags of this invention may be placed.
Figure 4:
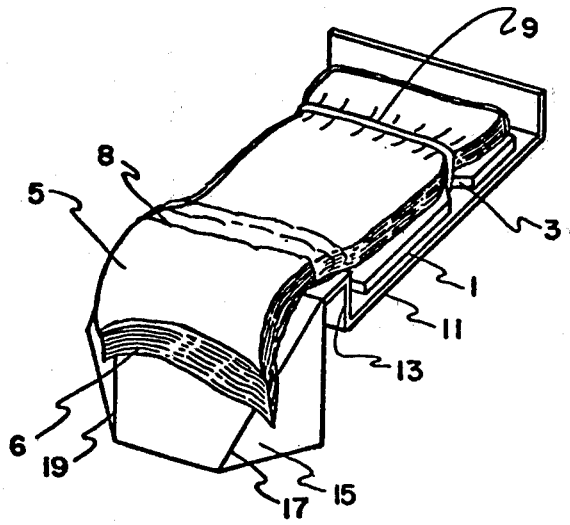
FIG. 4 is an isometric view of the holder of FIG. 4 having a coinciding stack of bags pinched to a dispensing surface placed thereon.

FIG. 3 of the drawings shows a holder 11 which may be combined with a backing board to further define a dispensing surface in accordance with this invention. FIG. 4 of the drawings shows a stack of bags 5 attached to an abbreviated backing board 1 with the remainder of holder 11 defining the dispensing surface on which the opened end 6 of the stack of bags rests. As can be seen in FIG. 4 of the drawings, the backing board 1 rests against a retaining ledge 13 of the holder 11 so that the opened end 6 may be displayed upon a truncated portion. Such an arrangement as shown in FIG. 4 permits the operator to readily find a bag edge when grasping for bags from behind without actually viewing the display of bags. In the arrangement shown in FIG. 4, the truncated surfaces 15 and edges 17 and 19 readily lead a grasping hand toward the opened end 6 of the stack of bags 5. The action of backing board 1 against the retaining ledge 13 of the holder 11 prevents the stack of bags from being removed from the holder 11 upon removal of the top bag.

An advantage of the arrangement shown in FIG. 4 is that the stack of bags 5 may be shipped attached to an abbreviated backing board 1 by folding the bags either over or under the abbreviated backing board. The folded bags may be readily set in a holder such as 11 and unfolded to display the bags on the dispensing surface.

It is thus seen that the assemblage of bags in accordance with this invention provide a novel technique of readily dispensing a plurality of bags without need for complicated auxiliary equipment. While many variations will be apparent to those in the art upon reading of the above specification, such variations are embedded within the spirit and scope of this invention as defined by the following appended claims.

What is claimed is:

1. Bag dispensing means comprising:

backing board means having a stack of bags retained thereon;

backing board receiving means comprising a backing board support surface terminating in an upright ledge with said ledge being adapted to abuttingly retain said backing board means;

truncated portion means attached along at least one edge thereof to said upright ledge and comprising truncated surfaces and edges; and wherein said backing board means is supported by said backing board receiving means and is abuttingly retained by said upright ledge and the mouths of said stack of bags at least partially overlie the truncated surfaces and edges of said truncated portion means; and whereby said truncated portion means is adapted to lead a hand toward the mouths of said stack of bags.

2. The bag dispensing means of claim 1, wherein said backing board means defines a substantially planar surface.

3. The bag dispensing means of claim 1, wherein said backing board means defines a substantially convexly curved surface.

4. The bag dispensing means of claim 1, wherein said backing board means defines a substantially concavely curved surface.

* * * * *